US009395124B2

(12) United States Patent
Kim et al.

(10) Patent No.: US 9,395,124 B2
(45) Date of Patent: Jul. 19, 2016

(54) INDOOR DEVICE FOR AN AIR CONDITIONER

(71) Applicant: LG ELECTRONICS INC., Seoul (KR)

(72) Inventors: Kidong Kim, Seoul (KR); Yungkoo Lee, Seoul (KR); Dongsoo Moon, Seoul (KR); Jungwoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 738 days.

(21) Appl. No.: 13/766,992

(22) Filed: Feb. 14, 2013

(65) Prior Publication Data

US 2013/0248149 A1 Sep. 26, 2013

(30) Foreign Application Priority Data

Feb. 15, 2012 (KR) ..... 10-2012-0015298

(51) Int. Cl.
*F28F 7/00* (2006.01)
*F24F 1/00* (2011.01)

(52) U.S. Cl.
CPC ..... *F28F 7/00* (2013.01); *F24F 1/0018* (2013.01); *F24F 1/0022* (2013.01)

(58) Field of Classification Search
CPC ..... F04D 13/064; F04D 15/0033; F04D 25/0633; F04D 25/08; F04D 25/12; F04D 29/048; F04D 29/058
See application file for complete search history.

(56) References Cited

U.S. PATENT DOCUMENTS 4,164,690 A * 8/1979 Muller ..... F04D 25/0653 310/63
4,459,087 A * 7/1984 Barge ..... F01P 5/04 123/41.12
4,553,075 A * 11/1985 Brown ..... F04D 25/0606 310/63
4,563,622 A * 1/1986 Deavers ..... H02P 6/14 310/156.12
6,194,798 B1 * 2/2001 Lopatinsky ..... F04D 25/066 310/62
6,744,172 B2 * 6/2004 Duhua ..... F04D 25/066 29/596
8,057,166 B2 * 11/2011 Hsiao ..... F04D 25/02 415/122.1
2005/0044877 A1 * 3/2005 Chin ..... F24F 1/0007 62/419
2007/0075598 A1 4/2007 Tung et al.
2007/0286726 A1 12/2007 Yabuuchi
2008/0240920 A1 * 10/2008 Ikeda ..... B64C 27/12 416/179
2009/0027853 A1 * 1/2009 Simofi-Ilyes ..... F04D 25/066 361/695

FOREIGN PATENT DOCUMENTS

CN 101008510 A 8/2007
CN 201265540 Y 7/2009
CN 101512237 A 8/2009
JP 2003-042094 A 2/2003
WO WO 2011/046289 A2 4/2011

OTHER PUBLICATIONS

Chinese Office Action dated Jan. 7, 2015, issued in Application No. 201310049335.8.

* cited by examiner

*Primary Examiner* — Igor Kershteyn
(74) *Attorney, Agent, or Firm* — Ked & Associates LLP

(57) ABSTRACT

An indoor device is provided. The indoor device may include a base to be fixed to an indoor wall; a fan disposed on the base that blows air; an orifice disposed upstream of the fan that guides air to the fan; a heat exchanger disposed upstream of the orifice that allows air to exchange heat with a refrigerant; and a magnet disposed at the fan and having magnetism.

14 Claims, 3 Drawing Sheets

INDOOR DEVICE FOR AN AIR CONDITIONER

CROSS-REFERENCE TO RELATED APPLICATION(S)

This application claims priority under 35 U.S.C. §119 to Korean Application No. 10-2012-0015298 filed in Korea on Feb. 15, 2012, whose entire disclosure is hereby incorporated by reference.

BACKGROUND

1. Field

An indoor device is disclosed herein.

2. Background

Indoor devices for air conditioners are known. However, they suffer from various disadvantages.

BRIEF DESCRIPTION OF THE DRAWINGS

Embodiments will be described in detail with reference to the following drawings in which like reference numerals refer to like elements, wherein.

DETAILED DESCRIPTION

Figure 1:
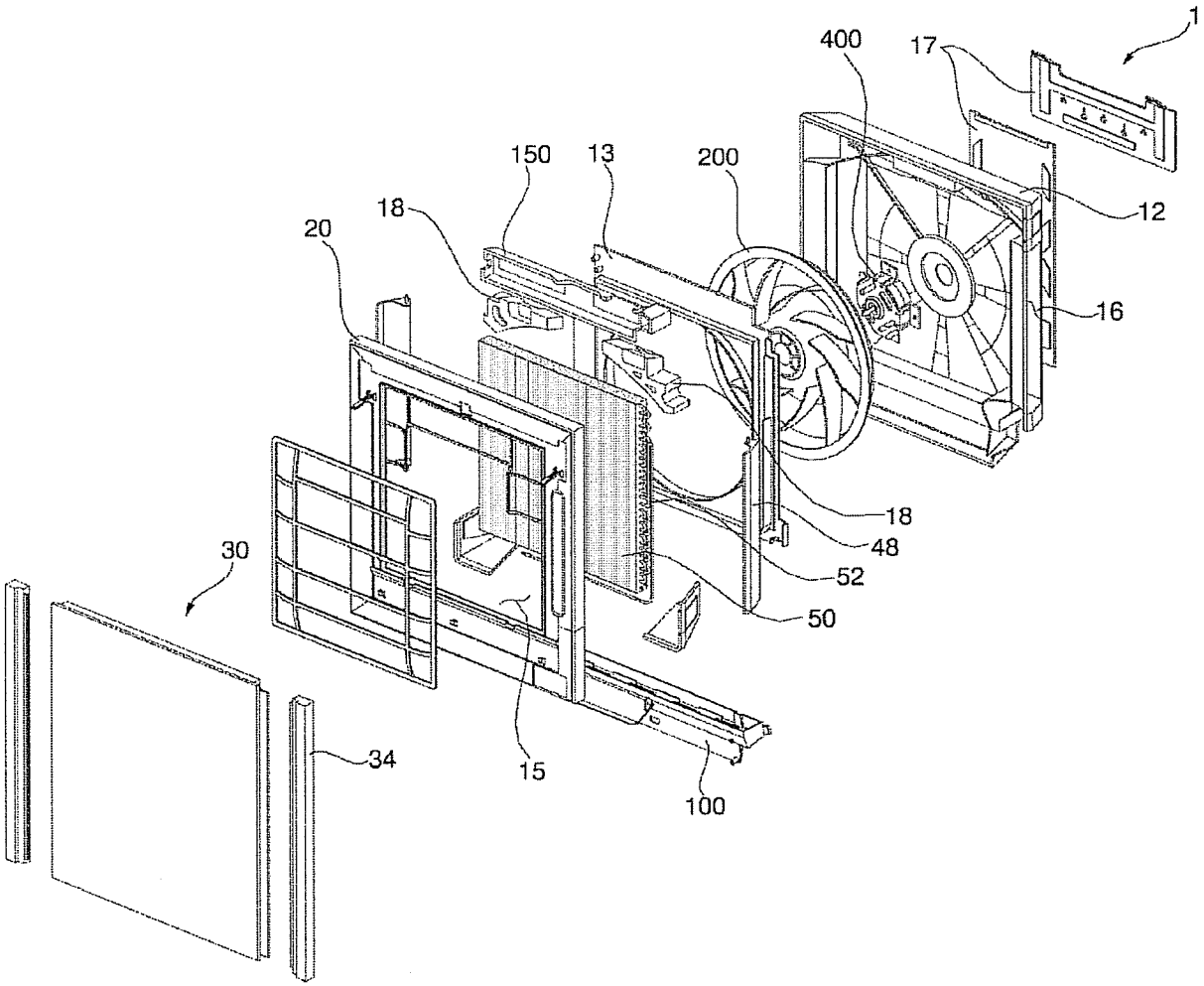
FIG. 1 is an exploded perspective view of an indoor device according to an embodiment.

Hereinafter, embodiments will be described with reference to the drawings. Where possible, like reference numerals have been used to indicate like elements.

In general, air conditioners are apparatuses that may include a compressor, an outdoor device with an outdoor heat exchanger, an expansion valve, and an indoor device with an indoor heat exchanger, to cool or heat an indoor room or space, for example, using a cooling cycle. That is, air conditioners may include a cooler that cools an interior room or space and a heater that heats the interior room or space.

The indoor device of the air conditioners may be equipped with a fan disposed in an indoor room or space that blows indoor air. Recently, indoor devices have been made in frame types with various demands on design in some cases, and fans of the indoor devices have been arranged with a rotational center extending horizontally. When a fan with a horizontally extending rotational center inclines or droops, it may reach or contact a case or chassis of the indoor device, which may cause noise and/or breakdown.

FIG. 1 is an exploded perspective view of an indoor device according to an embodiment. The indoor device 1 according to this embodiment may include a base 12 fixed to a wall, such as an indoor wall of a room or indoor space, a fan 200 disposed on the base 12 that blows air, an orifice 13 disposed ahead or upstream of the fan 200 that guides the air to the fan 200, a heat exchanger 50 disposed ahead or upstream of the orifice 13 that allows the air to exchange heat with a cooling fluid, such as a refrigerant, a front panel 20 disposed ahead or upstream of the heat exchanger 50, and a frame panel 30 disposed on a front of the front panel 20.

The front panel 20 may include an intake port 15 at a center thereof, through which air may be sucked. The front panel 20 may be fixed to the base 12.

The frame panel 30 may be disposed ahead or upstream of the front panel 20 with a predetermined gap therebetween. Air may be sucked to the intake port 15 through the gap between the front panel 20 and the frame panel 30.

The base 12 may be fixed to a wall, such as a wall of an indoor room or space by a bracket 17 at a rear thereof. Both sides of the base 12 may surround the fan 200. A discharge port 16 that guides the air blown by the fan 200 to the outside may be formed at both sides of the base 12. A vane 48 may be disposed at the discharge port 16 to open/close the discharge port 16. Air guides 18 that guide the air discharged through the fan 200 to the discharge ports 16 at both sides of the base 12 may be disposed at upper portions of the base 12.

The base 12 may be combined with the orifice 13 and the front panel 20. A motor 400 may be disposed at a center of the base 12. The motor 400 may rotate the fan 200.

The orifice 13 may be disposed ahead or upstream of the fan 200. A flow hole 13*b*, which may be circular and through which the air sucked to the intake port 15 of the front panel 20 may be guided to the fan 200, may be formed at the orifice 13. An electric mount 150 with circuits, such as electronic devices, may be disposed above the orifice 13.

The fan 200 may be disposed between the base 12 and the orifice 13 to blow the air sucked through the flow hole 13*b* to the discharge ports 16. The fan 200 may be arranged with a rotational center thereof extending in a substantially horizontal direction. According to one embodiment, the fan 200 may be a centrifugal fan that circumferentially discharges air through the orifice 13.

The heat exchanger 50 may be disposed between the front panel 20 and the orifice 13. The heat exchanger 50 may allow the indoor air sucked through the intake port 15 of the front panel 20 to exchange heat with a cooling fluid, such as a refrigerant. The heat-exchanged air may flow to the fan 200 through the flow hole 13*b* of the orifice 13.

The heat exchanger 50 may be fixed to the front panel 20 or the orifice 13 and may include a connection pipe 52 at one side thereof to connect with a refrigerant pipe (not shown) provided from the outside. A drain pan 100 may be disposed under the heat exchanger 50 to store and discharge condensed water produced by the heat exchanger 50.

Figure 2:
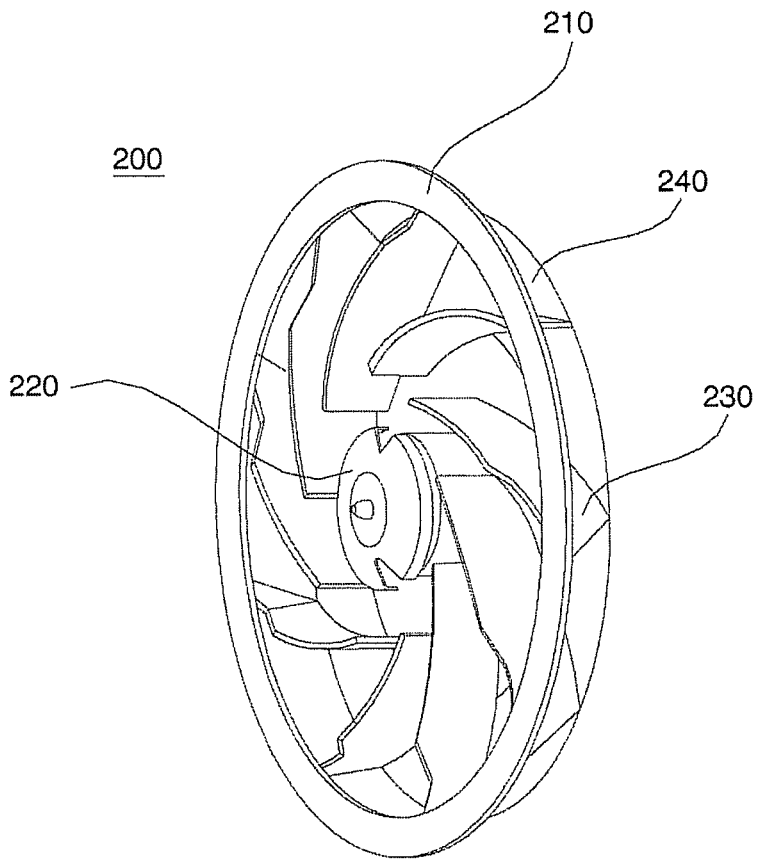
FIG. 2 is a perspective view of a fan in an indoor device according to an embodiment.

FIG. 2 is a perspective view of a fan in an indoor device according to an embodiment. The fan 200 according to one embodiment may include a rim 210, a hub 220, which may be disposed at a center of the rim 210, a plurality of blades 230 disposed around the hub 220, and a fan base 240 that connects the hub 220 with the plurality of blades 230. The rim 210 may be ring-shaped. The fan base 240 may be disc-shaped.

The hub 220 may be connected with the motor 400, forming a center of the fan 200. The plurality of blades 230 may be disposed around the hub 220. Outer ends of the plurality of blades 230 may be connected with the rim 210. One side of each of the blades 230 may be connected with the fan base 240.

The hub 220 may be disposed at the center of the fan base 240. The hub 220 may be integrally formed with the fan base 240. The fan base 240 may be spaced from the rim 210 and the plurality of blades 230 may be disposed between the fan base 240 and the rim 210.

Figure 3:
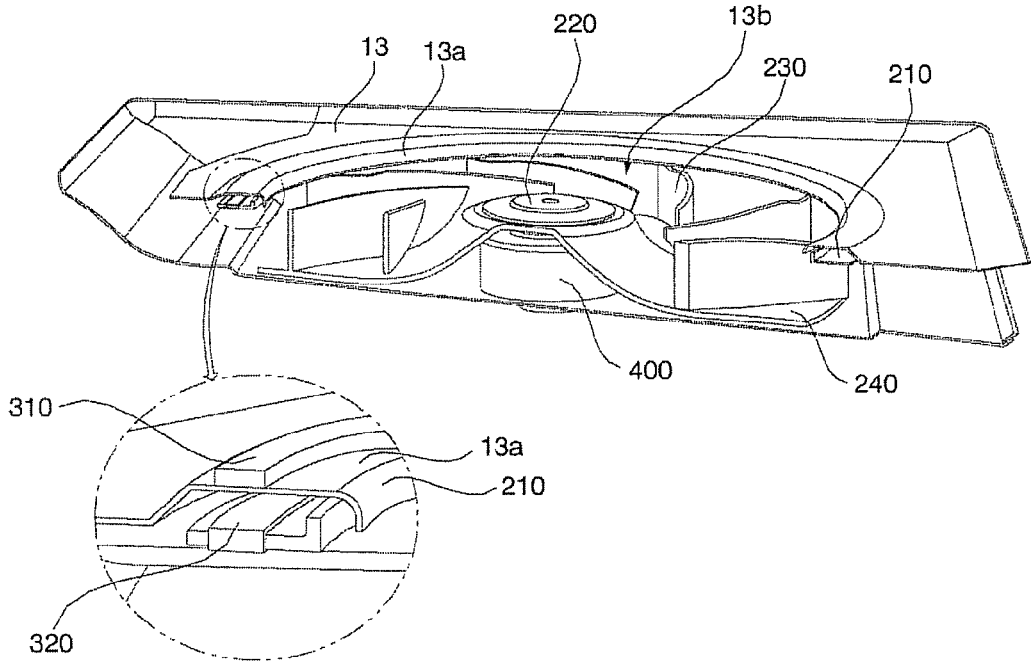
FIG. 3 is an enlarged view showing structure of a portion of the indoor device according to an embodiment.

FIG. 3 is an enlarged view showing structure of a portion of the indoor device according to an embodiment. The indoor device 1 according to one embodiment may include one or more first magnet(s) 320 disposed in the fan 200 and having magnetism, and one or more second magnet(s) 310 disposed opposite the first magnet(s) 320 and having magnetism.

The first magnet(s) 320 may apply a magnetic force with the second magnet(s) 310. The first magnet(s) 320 may apply a repulsive force with the second magnet(s) 310. The first magnet(s) 320 may be disposed in or on the rim 210 of the fan 200. The first magnet(s) 320 may be formed in a ring shape, corresponding to the rim 210, wherein the rim 210 is ring-shaped, or may be composed of a plurality of magnets disposed at regular intervals along the rim 210.

Alternatively, the first magnet(s) 320 may be disposed in or on the fan base 240. In this case, the first magnet(s) 320 may have a ring shape or a disc shape or may be composed of a plurality of magnets disposed at regular intervals in the fan base 240.

The second magnet(s) 310 may be disposed in or on the base 12 or the orifice 13. For example, the second magnet(s) 310 may be disposed in or on the orifice 13, and may be formed in a ring shape and disposed around the flow hole 13*b* of the orifice 13.

An orifice guide 13*a*, which may be ring-shaped, may be formed around the flow hole 13*b*, and the second magnet(s) 310 may be disposed in or on the orifice guide 13*a*. The second magnet(s) 310 may be may be formed in a ring shape, corresponding to the orifice guide 13*a*, or may be composed of a plurality of magnets disposed at regular intervals along the orifice guide 13*a*.

Alternatively, the second magnet(s) 310 may be disposed at or on the base 12. In this case, the first magnet(s) 320 may be disposed at or on the fan base 240, and the second magnet 310 may be disposed at or on the base 12, opposite the first magnet(s) 320. The first and second magnet(s) 320, 310 may have a ring shape or a disc shape or may be composed of a plurality of magnets disposed at regular intervals.

A repulsive force may be exerted between the first magnet(s) 320 and the second magnet(s) 310, such that the fan 200 may be prevented from inclining or drooping.

Operation of an indoor device with the configuration as described above according to embodiments will be described hereinbelow as follows.

As the motor 400 rotates the fan 200, air may be sucked to the intake port 15 through the gap between the front panel 20 and the frame panel 30. The indoor air sucked to the intake port 15 may exchange heat with a cooling fluid through the heat exchanger 50 and flow to the fan 200 through the flow hole 13*b* of the orifice 13. The air flowing to the fan 200 may be discharged to an indoor room or space through the discharge port 16.

The fan 200 may be prevented from inclining or drooping regardless of whether it rotates, by the magnetic force exerted between the first magnet(s) 320 and the second magnet(s) 310. Therefore, the fan 200 may be prevented from reaching and/or contacting the orifice 13 or the base 12 or other components of the indoor device.

With an indoor device according to embodiments disclosed herein, one or more advantages may be achieved including the following. First, there is an advantage that noise and breakdown may be prevented, as the fan may be prevented from inclining or drooping by magnets. Second, there is an advantage that the fan may not incline or droop due to the ring-shaped magnets, such that the magnetic force does not tend to one side. Third, there is an advantage that the indoor device may be used for existing products, because permanent magnets may be used to change existing indoor devices.

Embodiments disclosed herein provide an indoor device with a non-inclining or non-drooping fan therein.

Embodiments disclosed herein provide an indoor device that may include a base fixed to an indoor wall; a fan disposed on the base that blows air; an orifice disposed ahead or upstream of the fan that guides air to the fan; a heat exchanger disposed ahead or upstream of the orifice that allows air to exchange heat with a refrigerant or cooling fluid; and a first magnet disposed at the fan and having magnetism.

Embodiments disclosed herein provide an indoor unit that may include a base fixed to an indoor wall; a fan disposed on the base that blows air; an orifice disposed ahead or upstream of the fan that guides air to the fan; a heat exchanger disposed ahead or upstream of the orifice that allows air to exchange heat with a refrigerant or cooling fluid; a first magnet disposed at the fan and having magnetism; and a second magnet disposed opposite the first magnet, having magnetism, that prevents the fan from inclining or drooping by applying a magnetic force with the first magnet.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An indoor device for an air conditioner, comprising:
- a base to be fixed to a wall;
- a fan disposed on the base that blows air;
- an orifice disposed upstream of the fan that guides air to the fan;
- a heat exchanger disposed upstream of the orifice that allows air to exchange heat with a cooling fluid; and
- at least one first magnet disposed at or on the fan and having magnetism, wherein the fan includes:
  - a rim;
  - a hub disposed at a center of the rim; and
  - a plurality of blades disposed around the hub, wherein the at least one first magnet is disposed at or on the rim, wherein the orifice includes a flow hole, through which air flows, and at least one second magnet disposed around the flow hole of the orifice, opposite the at least one first magnet, and having magnetism, wherein the orifice includes an orifice guide around the flow hole and the at least one second magnet is disposed at or on the orifice guide, and wherein at least one the second magnet has a ring shape.

2. The indoor device of claim 1, wherein the rim is ring-shaped.

3. The indoor device of claim 1, wherein outer ends of the plurality of blades are connected with the rim.

4. The indoor device of claim 1, wherein the at least one first magnet has a ring shape.

5. The indoor device of claim 1, wherein the flow hole is circular.

6. The indoor device of claim 1, wherein the fan further includes a fan base that connects the hub with the plurality of blades, and wherein the at least one first magnet is disposed at or on the fan base.

7. The indoor device of claim 6, wherein the fan base is disc-shaped.

8. The indoor device of claim 6, wherein the at least one first magnet has a ring shape or a disc shape.

9. The indoor device of claim 1, wherein the at least one magnet includes a plurality of the first magnets disposed at regular intervals at or on the fan base.

10. The indoor device of claim 1, wherein one side of each of the plurality of blades is connected with the fan base.

11. The indoor device of claim 1, wherein the hub is integrally formed with the fan base.

12. The indoor device of claim 1, further including at least one second magnet disposed at or on the base, opposite the at least one first magnet, and having magnetism.

13. An air conditioner including the indoor device of claim 1.

14. An indoor device for an air conditioner, comprising:

a base to be fixed to a wall;

a fan disposed on the base that blows air;

an orifice disposed upstream of the fan that guides air to the fan;

a heat exchanger disposed upstream of the orifice that allows air to exchange heat with a cooling fluid;

at least one first magnet disposed at or on the fan and having magnetism, wherein the fan includes:

a rim;

a hub disposed at a center of the rim;

a plurality of blades disposed around the hub; and a fan base that connects the hub with the plurality of blades, wherein the at least one first magnet is disposed at or on the fan base.

* * * * *